US009262964B2

(12) United States Patent
Nam et al.

(10) Patent No.: US 9,262,964 B2
(45) Date of Patent: Feb. 16, 2016

(54) ORGANIC LIGHT EMITTING DISPLAY AND METHOD OF COMPENSATING FOR IMAGE QUALITY THEREOF

(71) Applicant: LG Display Co., Ltd., Seoul (KR)

(72) Inventors: Woojin Nam, Goyang-si (KR); Jintaek Choi, Goyang-si (KR); Seongmin Choi, Gwangju (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/547,878

(22) Filed: Nov. 19, 2014

(65) Prior Publication Data

US 2015/0154908 A1 Jun. 4, 2015

(30) Foreign Application Priority Data

Dec. 3, 2013 (KR) ..... 10-2013-0149395

(51) Int. Cl.
*G09G 3/32* (2006.01)

(52) U.S. Cl.
CPC ..... *G09G 3/3233* (2013.01); *G09G 2300/0408* (2013.01); *G09G 2300/0842* (2013.01); *G09G 2310/0251* (2013.01); *G09G 2320/0295* (2013.01); *G09G 2320/041* (2013.01); *G09G 2320/045* (2013.01); *G09G 2330/08* (2013.01)

(58) Field of Classification Search
CPC ..... G09G 3/3233; G09G 2300/0819; G09G 2320/043; G09G 2320/045; G09G 2310/0251; G09G 3/3208; G09G 3/3258; G09G 2320/0295; G09G 2320/029; G09G 2320/0693; G09G 2300/043; G09G 2300/0861
See application file for complete search history.

(56) References Cited

U.S. PATENT DOCUMENTS

| | | | | |
|---|---|---|---|---|
| 7,355,574 | B1 * | 4/2008 | Leon et al. | 345/82 |
| 2009/0051628 | A1 | 2/2009 | Kwon | |
| 2010/0039422 | A1 | 2/2010 | Seto | |
| 2010/0103082 | A1 | 4/2010 | Levey et al. | |
| 2010/0188390 | A1 | 7/2010 | Min et al. | |
| 2011/0032264 | A1 | 2/2011 | Ietomi | |
| 2013/0083001 | A1 * | 4/2013 | Jeong | 345/212 |
| 2013/0147690 | A1 * | 6/2013 | Kim et al. | 345/76 |
| 2014/0361960 | A1 | 12/2014 | Yamauchi | |

FOREIGN PATENT DOCUMENTS

| | | | |
|---|---|---|---|
| JP | 2009-53647 | A | 3/2009 |
| JP | 2010-44299 | A | 2/2010 |
| JP | 2011-34004 | A | 2/2011 |
| JP | 2012-507041 | A | 3/2012 |

(Continued)

*Primary Examiner* — Charles Hicks
*Assistant Examiner* — Charles Zheng
(74) *Attorney, Agent, or Firm* — Birch, Stewart, Kolasch & Birch, LLP

(57) ABSTRACT

Provided is an organic light emitting diode (OLED) display device including a plurality of pixels to display images, each of the pixels including an OLED, a driving transistor connected to the OLED, and a switching transistor configured to supply data signals to the OLED, the device including: a sensor configured to sense a change amount of a mobility of the driving transistor; a compensation value calculator configured to obtain a change amount of a threshold voltage of the driving transistor based on the sensed change amount of the mobility; and a data compensator configured to adjust the data signals based on the sensed change amount of mobility and the obtained change amount of the threshold voltage.

16 Claims, 16 Drawing Sheets

(56) References Cited

FOREIGN PATENT DOCUMENTS

| | | | |
|---|---|---|---|
| WO | WO 2009/075242 | A1 | 6/2009 |
| WO | WO 2009/145881 | A1 | 12/2009 |
| WO | WO 2013/094422 | A1 | 6/2013 |

* cited by examiner

FIG. 3

(RELATED ART)

Change ratio of pixel current depending on change in Vth and/or $\mu$ at each gray level

| ratio | 31gray | 63gray | 127gray | 255gray | peak |
|---|---|---|---|---|---|
| Change of only Vth | 154.72% | 126.52% | 113.12% | 106.37% | 102.02% |
| Change of Vth and $\mu$ (reality) | 205.93% | 157.98% | 136.63% | 125.53% | 118.45% |
| Change of only $\mu$ | 136.93% | 126.28% | 121.08% | 118.19% | 116.22% |

Low gray level: Increase in influence of Vth
High gray level: Increase in influence of $\mu$

ORGANIC LIGHT EMITTING DISPLAY AND METHOD OF COMPENSATING FOR IMAGE QUALITY THEREOF

This application claims the benefit of and priority to Korea Patent Application No. 10-2013-0149395 filed on Dec. 3, 2013, which is incorporated herein by reference for all purposes as if fully set forth herein.

BACKGROUND OF THE INVENTION

1. Field of the Invention

Embodiments of the invention relate to an active matrix organic light emitting display, and more particularly to an organic light emitting display and a method of compensating for image quality thereof.

2. Discussion of the Related Art

An active matrix organic light emitting display includes organic light emitting diodes ("OLEDs") capable of emitting light by itself and has advantages of a fast response time, a high light emitting efficiency, a high luminance, a wide viewing angle, and the like.

The OLED serving as a self-emitting element includes an anode electrode, a cathode electrode, and an organic compound layer formed between the anode electrode and the cathode electrode. The organic compound layer includes a hole injection layer HIL, a hole transport layer HTL, a light emitting layer EML, an electron transport layer ETL, and an electron injection layer EIL. When a driving voltage is applied to the anode electrode and the cathode electrode, holes passing through the hole transport layer HTL and electrons passing through the electron transport layer ETL move to the light emitting layer EML and form excitons. As a result, the light emitting layer EML generates visible light.

The organic light emitting display arranges pixels each including the OLED in a matrix form and adjusts a luminance of the pixels depending on a gray scale of video data. Each pixel includes a driving thin film transistor (TFT) for controlling a driving current flowing in the OLED. It is preferable that electrical characteristics (including a threshold voltage, a mobility, etc.) of the driving TFT are equally designed in all of the pixels. However, in practice, the electrical characteristics of the driving TFTs of the pixels are not uniform by process conditions, a driving environment, and the like. The driving currents from the same data voltage in the pixels are different because of these reasons, and thus a luminance deviation between the pixels is generated. A compensation technology of the image quality has been known so as to solve the problem. The compensation technology senses a characteristic parameter (for example, the threshold voltage, the mobility, etc.) of the driving TFT of each pixel and properly corrects input data based on the sensing result, thereby reducing the non-uniformity of the luminances.

In the related art image quality compensation technology, a method for sensing a change amount of the threshold voltage of the driving TFT and a sensing period thereof are different from a method for sensing a change amount of the mobility of the driving TFT and a sensing period thereof.

As shown in FIGS. 1 and 2A, a sensing method 1 for extracting a change in a threshold voltage Vth of a driving TFT DT detects a source voltage Vs of the driving TFT DT as a sensing voltage VsenA after operating the driving TFT DT in a source follower manner, and detects a change amount of the threshold voltage Vth of the driving TFT DT based on the sensing voltage VsenA. The change amount of the threshold voltage Vth of the driving TFT DT is determined depending on a magnitude of the sensing voltage VsenA, and an offset value for data compensation is obtained through this. In the sensing method 1, after a gate-source voltage Vgs of the driving TFT DT operating in the source follower manner reaches a saturation state (where a drain-source current of the driving TFT DT becomes zero), a sensing operation has to be performed. Therefore, the sensing method 1 is characterized in that time required in the sensing operation is long, and a sensing speed is slow. The sensing method 1 is called a slow mode sensing method.

As shown in FIGS. 1 and 2B, a sensing method 2 for extracting a change in a mobility μ of the driving TFT DT applies a predetermined voltage Vdata+X (where X is a voltage according to the compensation of the offset value) greater than the threshold voltage Vth of the driving TFT DT to a gate electrode of the driving TFT DT, so as to prescribe characteristic of a current capability except the threshold voltage Vth of the driving TFT DT. Hence, the driving TFT DT is turned on. In this state, the sensing method 2 detects the source voltage Vs of the driving TFT DT, which is charged for a predetermined period of time, as a sensing voltage VsenB. The change amount of the mobility μ of the driving TFT DT is determined depending on a magnitude of the sensing voltage VsenB, and a gain value for data compensation is obtained through this. Because the sensing method 2 is performed in the turned-on state of the driving TFT DT, the sensing method 2 is characterized in that time required in the sensing operation is short, and a sensing speed is fast. The sensing method 2 is called a fast mode sensing method.

Because the sensing speed in the slow mode sensing method is slow, a sufficient sensing period is required. Namely, the slow mode sensing method for sensing the threshold voltage Vth of the driving TFT DT may be performed only during a first sensing period, which ranges from after an end of an image display to before the turn-off of a driving power in response to a power-off instruction signal received from a user, so that a sufficient sensing time can be assigned to the sensing operation without the recognition of the user. On the other hand, because the sensing speed in the fast mode sensing method for sensing the mobility μ of the driving TFT DT is fast, the fast mode sensing method may be performed during a second sensing period, which ranges from after the turn-on of the driving power to before the image display in response to a power-on instruction signal received from the user, or during vertical blank periods belonging to an image display driving period.

The offset value updated during the first sensing period and the gain value updated during the second sensing period affect each other. Namely, the gain value is obtained based on a data voltage, in which the offset value is reflected. Thus, the offset value updated in a power-off process has to be stored in a nonvolatile memory, so that the updated offset value can be used when the gain value is determined after a subsequent power-on process. As described above, in the related art compensation technology of image quality, the different sensing methods have to be used to find out the change amount of the threshold voltage and the change amount of the mobility. Therefore, the long time is required in the sensing operation, and the separate nonvolatile memory for storing the offset value is additionally needed and results in an increase in an amount of memory used.

Because the long time is required to sense the change amount of the threshold voltage, it is impossible to sense the change amount of the threshold voltage in a vertical blank period, which is disposed between adjacent image frames and has a relatively short length and in which an image is not displayed. Thus, when the organic light emitting display is driven for a long time and continuously displays an image, the related art image quality compensation technology cannot update the offset value based on the change amount of the threshold voltage. As a result, it is impossible to properly compensate for the change characteristic of the threshold voltage over a driving time.

FIG. 3 shows a change in the threshold voltage Vth of the driving TFT as well as a change in the mobility μ of the driving TFT over a driving time. When a temperature of the display panel rises because of the long time drive of the organic light emitting display, both the threshold voltage Vth and the mobility μ of the real driving TFT change. It is a matter of course that the change amount of the threshold voltage Vth of the driving TFT is less than the change amount of the mobility μ of the driving TFT depending on a rise in the temperature. However, even if the change amount of the threshold voltage Vth is small at a low gray level as compared with a high gray level, the change amount of the threshold voltage Vth may have a relatively large influence on a change in a pixel current. Therefore, the change amount of the threshold voltage Vth of the driving TFT is important. As can be shown from FIG. 3, a change ratio of the pixel current largely depends on the change amount of the threshold voltage Vth at the low gray level. For example, the change ratio of the pixel current depending on the change amount of the threshold voltage Vth was about 155% at the low gray level '31' and was greater than the change ratio '137%' of the pixel current depending on the change amount of the mobility μ at the low gray level '31'. When the change in the threshold voltage Vth is not properly compensated, the non-uniformity of the pixel currents is generated. Therefore, a new compensation measure capable of compensating for the threshold voltage Vth as well as the mobility μ for a short period of time is required.

SUMMARY OF THE INVENTION

Embodiments of the invention provide an organic light emitting display and a method of compensating for image quality thereof capable of reducing time required in a sensing operation and an amount of memory used in the sensing operation and increasing the accuracy of compensation.

According to one aspect of the embodiments, an organic light emitting diode (OLED) display device includes a plurality of pixels to display images, each of the pixels including an OLED, a driving transistor connected to the OLED, and a switching transistor configured to supply data signals to the OLED, the device including: a sensor configured to sense a change amount of a mobility of the driving transistor; a compensation value calculator configured to obtain a change amount of a threshold voltage of the driving transistor based on the sensed change amount of the mobility; and a data compensator configured to adjust the data signals based on the sensed change amount of mobility and the obtained change amount of the threshold voltage.

According to another aspect of the present embodiments, there is provided a method for compensating for variations of an OLED display device, the OLED display device including a plurality of pixels to display images, and each of the pixels including an OLED, a driving transistor connected to the OLED, and a switching transistor configured to supply data signals to the OLED, the method comprising: sensing a change amount of a mobility of the driving transistor; obtaining a change amount of a threshold voltage of the driving transistor based on the sensed change amount of the mobility; and adjusting the data signals based on the sensed change amount of the mobility and the obtained change amount of the threshold voltage.

According to yet another aspect of the embodiments, there is provided a method for compensating for variations of an OLED display device, the OLED display device including a plurality of pixels to display images, and each of the pixels including an OLED, a driving transistor connected to the OLED, and a switching transistor configured to supply data signals to the OLED, the method comprising: applying first and second data voltages to the driving transistor; sensing first and second output voltages from the driving transistor; obtaining a graph of functional relationship between the first and second output voltages with respect to and the first and second data voltages; obtaining a slope of a graph representing the functional relationship with respect to data voltages; obtaining a reference slope of a reference graph representing reference output voltages with respect to reference data voltages on the driving transistor; and obtaining a change amount of a mobility of the driving transistor based on the slope and the reference slope.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 3 shows a change in a threshold voltage of a driving TFT as well as a change in a mobility of a driving TFT over a driving time;

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Exemplary embodiments of the invention will be described with reference to FIGS. 4 to 16. In the following embodiments of the invention, the change amount of the mobility of a transistor may be a difference in the mobility values of the transistor obtained or measured at different points in time. For example, the change amount of the mobility of a transistor is a difference between the initial mobility value of the transistor, which is determined or measured when manufacturing of the transistor is completed and a subsequent mobility value of the transistor, which is measured when the display device including the transistor is used. Likewise, the change amount of the threshold voltage of a transistor is a difference in the threshold voltages of the transistor obtained or measured at different points in time. For example, the change amount of the threshold voltage of a transistor is a difference between the initial threshold voltage of the transistor, which is determined or measured when manufacturing of the transistor is completed and a subsequent threshold voltage of the transistor, which is measured when the display device including the transistor is actually used.

Figure 1:
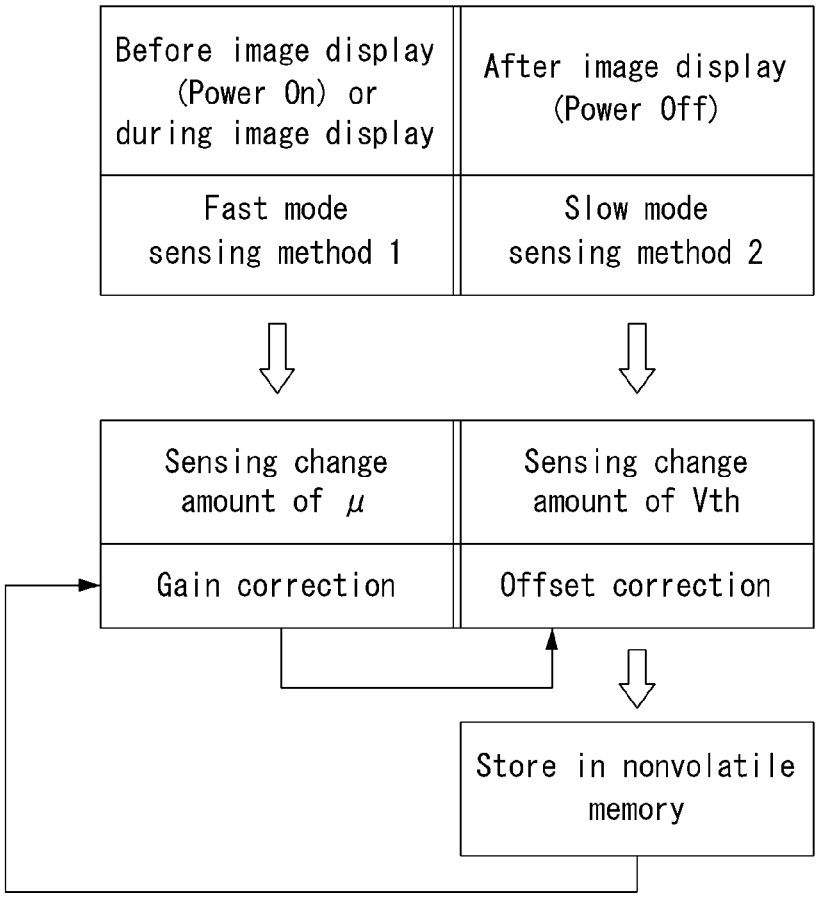
FIG. 1 (RELATED ART)
FIG. 1 illustrates a related art compensation technology of image quality.
Figure 2A:
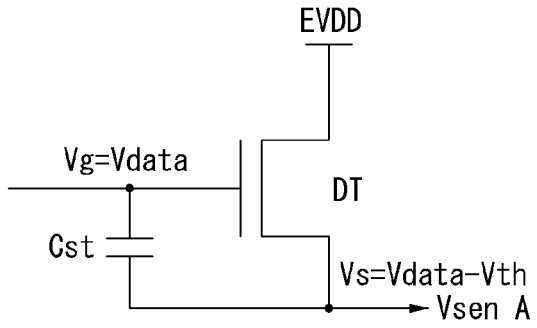
FIG. 2A (RELATED ART)
FIG. 2A illustrates a sensing principle for extracting a change in a threshold voltage of a driving thin film transistor (TFT) in a related art compensation technology of image quality.
Figure 2A:
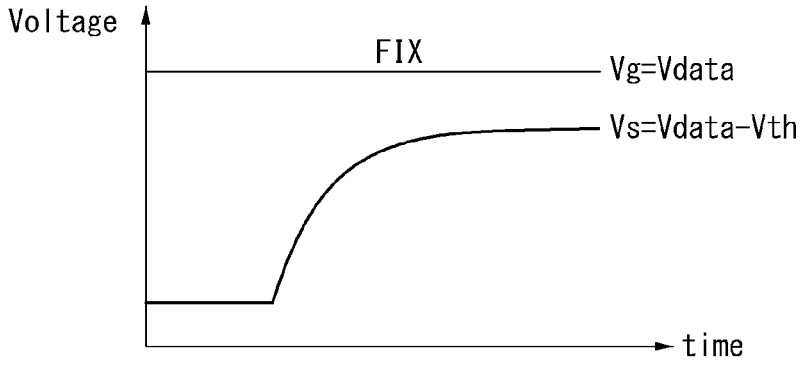
FIG. 2A (RELATED ART)
Figure 2B:
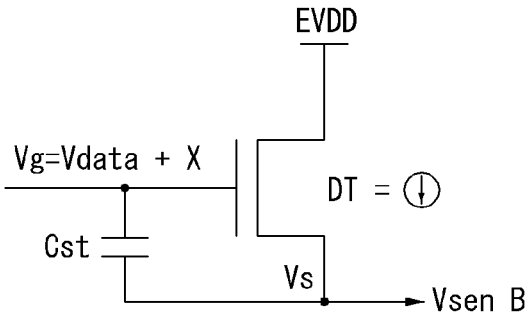
FIG. 2B (RELATED ART)
FIG. 2B illustrates a sensing principle for extracting a change in a mobility of a driving TFT in a related art compensation technology of image quality.
Figure 2B:
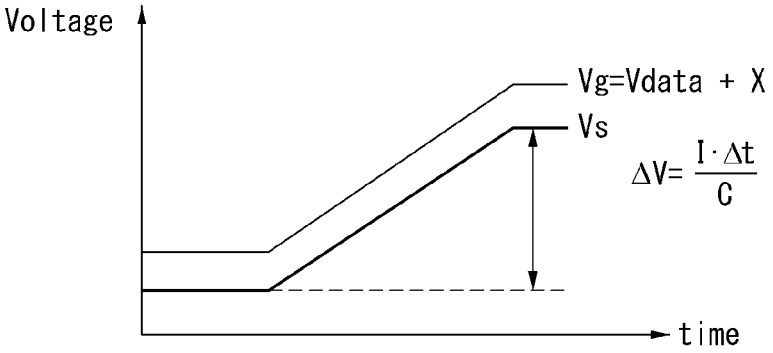
FIG. 2B (RELATED ART)
Figure 4:
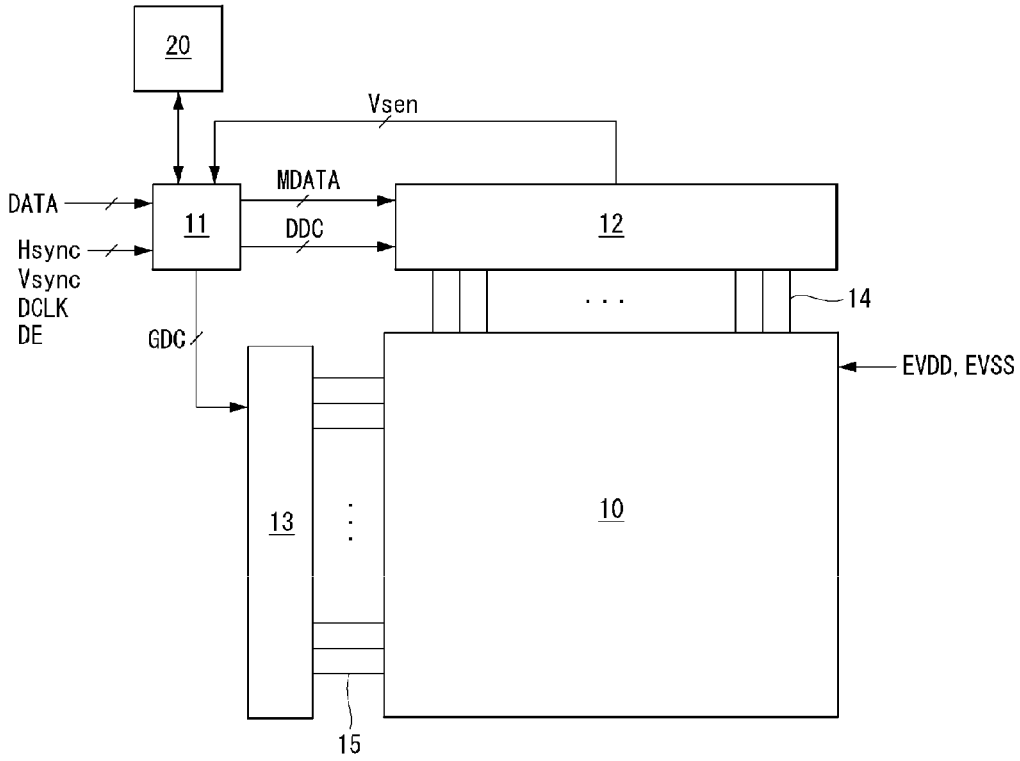
FIG. 4 is a block diagram of an organic light emitting display according to an exemplary embodiment of the invention.
Figure 5:
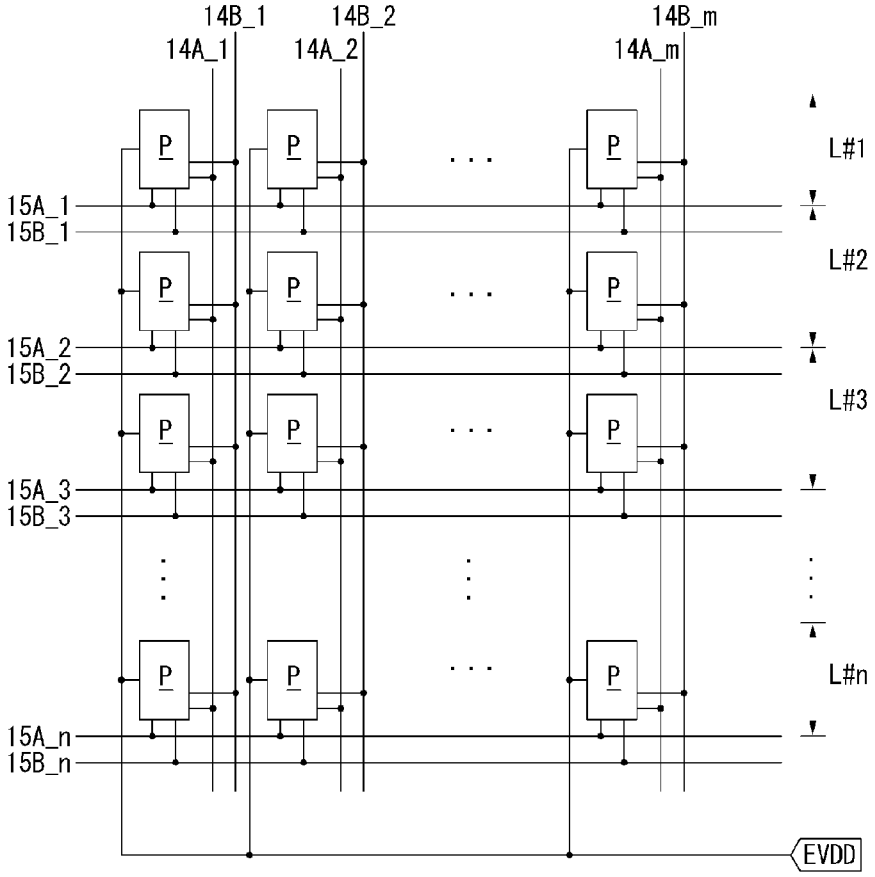
FIG. 5 shows a pixel array of a display panel shown in FIG. 4.

FIG. 4 is a block diagram of an organic light emitting display including an image quality compensation device according to an exemplary embodiment of the invention. FIG. 5 shows a pixel array of a display panel shown in FIG. 4.

As shown in FIGS. 4 and 5, the organic light emitting display according to the embodiment of the invention includes a display panel 10, a data driving circuit 12, a gate driving circuit 13, and a timing controller 11.

The display panel 10 includes a plurality of data lines 14, a plurality of gate lines 15 crossing the data lines 14, and a plurality of pixels P respectively arranged at crossings of the data lines 14 and the gate lines 15 in a matrix form. The data lines 14 include m data voltage supply lines 14A_1 to 14A_m and m sensing voltage readout lines 14B_1 to 14B_m, where m is a positive integer. The gate lines 15 include n first gate lines 15A_1 to 15A_n and n second gate lines 15B_1 to 15B_n, where n is a positive integer.

Each pixel P receives a high potential driving voltage EVDD and a low potential driving voltage EVSS from a power generator (not shown). Each pixel P may include an organic light emitting diode (OLED), a driving thin film transistor (TFT), first and second switch TFTs, and a storage capacitor for the external compensation. The TFTs constituting the pixel P may be implemented as a p-type or an n-type. Further, semiconductor layers of the TFTs constituting the pixel P may contain amorphous silicon, polycrystalline silicon, or oxide.

Each pixel P is connected to one of the data voltage supply lines 14A_1 to 14A_m, one of the sensing voltage readout lines 14B_1 to 14B_m, one of the first gate lines 15A_1 to 15A_n, and one of the second gate lines 15B_1 to 15B_n. In a sensing drive for finding out a change amount of a mobility and a change amount of a threshold voltage in the driving TFT, the pixels P sequentially operate based on each of horizontal lines L#1 to L#n and output sensing voltages through the sensing voltage readout lines 14B_1 to 14B_m in response to a first sensing gate pulse received from the first gate lines 15A_1 to 15A_n in a line sequential manner and a second sensing gate pulse received from the second gate lines 15B_1 to 15B_n in the line sequential manner. In an image display drive for the image display, the pixels P sequentially operate based on each of the horizontal lines L#1 to L#n and receive an image display data voltage through the data voltage supply lines 14A_1 to 14A_m in response to a first image display gate pulse received from the first gate lines 15A_1 to 15A_n in the line sequential manner and a second image display gate pulse received from the second gate lines 15B_1 to 15B_n in the line sequential manner.

In the sensing drive, the data driving circuit 12 supplies a sensing data voltage synchronized with the first sensing gate pulse to the pixels P based on a data control signal DDC from the timing controller 11 and also converts the sensing voltages received from the display panel 10 through the sensing voltage readout lines 14B_1 to 14B_m into digital values to supply the digital sensing voltages to the timing controller 11. In the image display drive, the data driving circuit 12 converts digital compensation data MDATA received from the timing controller 11 into the image display data voltage based on the data control signal DDC and then synchronizes the image display data voltage with the first image display gate pulse. The data driving circuit 12 then supplies the image display data voltage synchronized with the first image display gate pulse to the data voltage supply lines 14A_1 to 14A_m.

The gate driving circuit 13 generates a gate pulse based on a gate control signal GDC from the timing controller 11. The gate pulse may include the first sensing gate pulse, the second sensing gate pulse, the first image display gate pulse, and the second image display gate pulse. In the sensing drive, the gate driving circuit 13 may supply the first sensing gate pulse to the first gate lines 15A_1 to 15A_n in the line sequential manner and also may supply the second sensing gate pulse to the second gate lines 15B_1 to 15B_n in the line sequential manner. In the image display drive, the gate driving circuit 13 may supply the first image display gate pulse to the first gate lines 15A_1 to 15A_n in the line sequential manner and also may supply the second image display gate pulse to the second gate lines 15B_1 to 15B_n in the line sequential manner. The gate driving circuit 13 may be directly formed on the display panel 10 through a gate driver-in panel (GIP) process.

The timing controller 11 generates the data control signal DDC for controlling operation timing of the data driving circuit 12 and the gate control signal GDC for controlling operation timing of the gate driving circuit 13 based on timing signals, such as a vertical sync signal Vsync, a horizontal sync signal Hsync, a data enable signal DE, and a dot clock DCLK. Further, the timing controller 11 modulates input digital video data DATA based on the digital sensing voltages received from the data driving circuit 12 and generates the digital compensation data MDATA for compensating for a change in the mobility and a change in the threshold voltage in the driving TFT. The timing controller 11 then supplies the digital compensation data MDATA to the data driving circuit 12.

In the sensing drive, the timing controller 11 controls the operation timing of the data driving circuit 12 and the operation timing of the gate driving circuit 13, so that at least one sensing voltage can be obtained from each pixel P through a fast mode sensing method. Further, the timing controller 11 finds out the change amount of the mobility of the driving TFT based on a digital sensing voltage Vsen received from the data driving circuit 12 and then finds out the change amount of the threshold voltage of the driving TFT based on the obtained change amount of the mobility. The timing controller 11 determines a gain value for compensating for the change in the mobility of the driving TFT and an offset value for compensating for the change in the threshold voltage of the driving TFT. Then, the timing controller 11 applies the gain value and the offset value to the input digital video data DATA and generates the digital compensation data MDATA, which will be applied to the pixels P.

A memory 20 may store a reference voltage, which is the base for obtaining the change amount of the mobility, and reference compensation values, which are the base for determining the gain value and the offset value.

Figure 6:
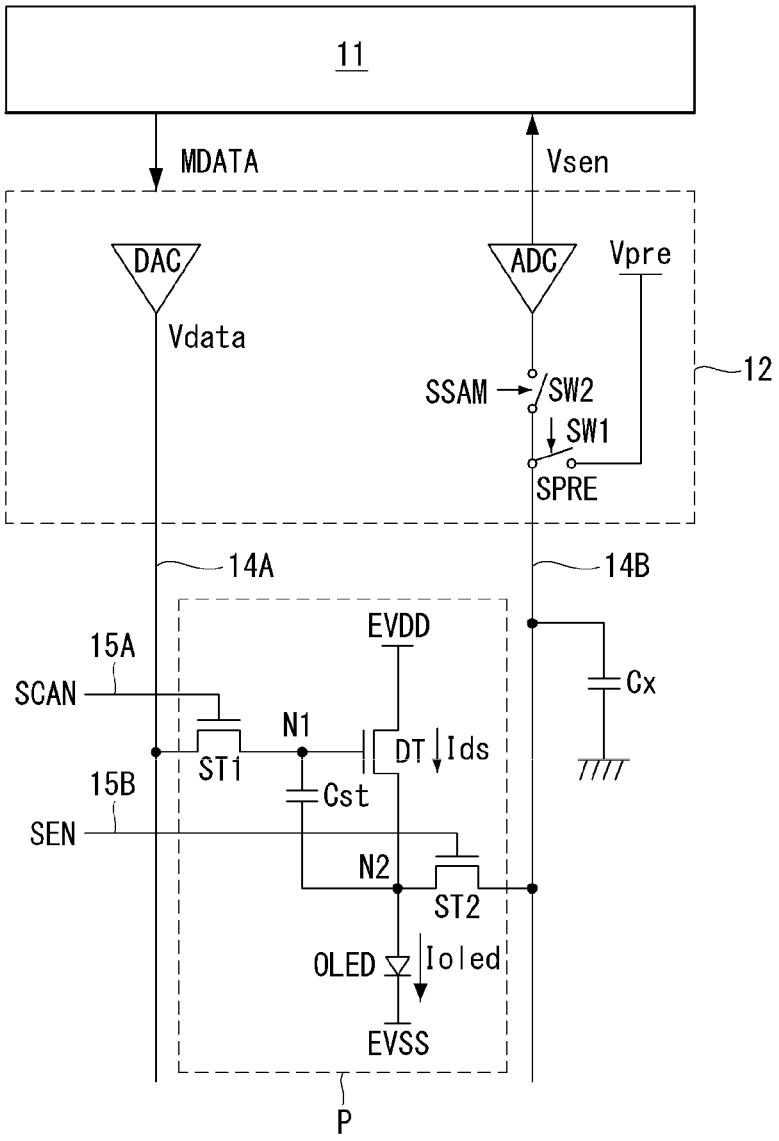
FIG. 6 illustrates a connection structure of a timing controller, a data driving circuit, and pixels along with a detailed configuration of an external compensation pixel.
Figure 7:
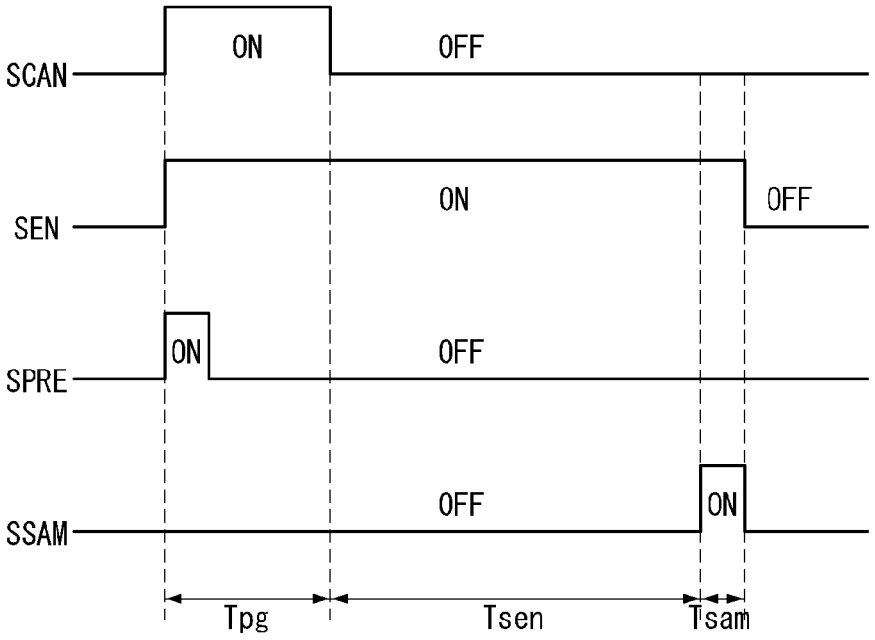
FIG. 7 shows timings of first and second sensing gate pulses and timings of sampling and initialization control signals capable of implementing the fast mode sensing in a sensing drive.
Figure 8:
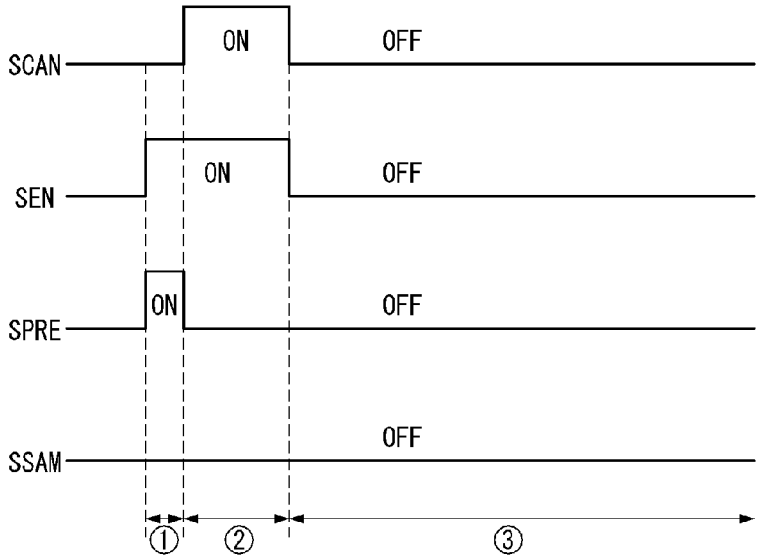
FIG. 8 shows timings of first and second image display gate pulses and timings of sampling and initialization control signals in an image display drive.
Figure 9:
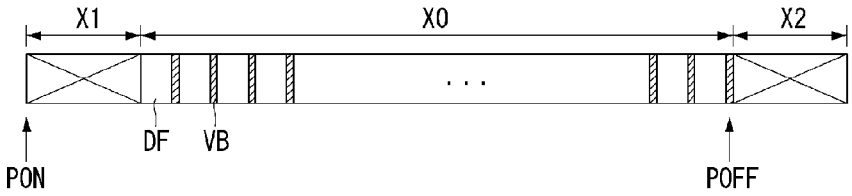
FIG. 9 shows an image display period and non-display periods disposed on both sides of the image display period.

FIG. 6 illustrates a connection structure of the timing controller, the data driving circuit, and the pixels along with a detailed configuration of an external compensation pixel. FIG. 7 shows timings of the first and second sensing gate pulses and timings of sampling and initialization control signals capable of implementing the fast mode sensing in the sensing drive. FIG. 8 shows timings of the first and second image display gate pulses and timings of sampling and initialization control signals in the image display drive. FIG. 9 shows an image display period and non-display periods disposed on both sides of the image display period.

As shown in FIG. 6, the pixel P may include an OLED, a driving TFT DT, a storage capacitor Cst, a first switch TFT ST1, and a second switch TFT ST2.

The OLED includes an anode electrode connected to a second node N2, a cathode electrode connected to an input terminal of a low potential driving voltage EVSS, and an organic compound layer positioned between the anode electrode and the cathode electrode.

The driving TFT DT controls a driving current Ioled flowing in the OLED depending on a gate-source voltage Vgs of the driving TFT DT. The driving TFT DT includes a gate electrode connected to a first node N1, a drain electrode connected to an input terminal of a high potential driving voltage EVDD, and a source electrode connected to the second node N2.

The storage capacitor Cst is connected between the first node N1 and the second node N2.

In the sensing drive, the first switch TFT ST1 applies the sensing data voltage (i.e., a predetermined voltage greater than a threshold voltage of the driving TFT DT) charged to the data voltage supply line 14A to the first node N1 in response to a first sensing gate pulse SCAN (refer to FIG. 7). In the image display drive, the first switch TFT ST1 applies the image display data voltage Vdata (i.e., the data voltage in which a change in the threshold voltage and a change in a mobility in the driving TFT DT are compensated) charged to the data voltage supply line 14A to the first node N1 in response to a first image display gate pulse SCAN (refer to FIG. 8), thereby turning on the driving TFT DT. The first switch TFT ST1 includes a gate electrode connected to the first gate line 15A, a drain electrode connected to the data voltage supply line 14A, and a source electrode connected to the first node N1.

In the sensing drive, the second switch TFT ST2 turns on a current flow between the second node N2 and the sensing voltage readout line 14B in response to a second sensing gate pulse SEN (refer to FIG. 7), thereby storing a source voltage of the second node N2 in a sensing capacitor Cx of the sensing voltage readout line 14B. In the image display drive, the second switch TFT ST2 turns on a current flow between the second node N2 and the sensing voltage readout line 14B in response to a second image display gate pulse SEN (refer to FIG. 8), thereby resetting a source voltage of the driving TFT DT to an initialization voltage Vpre. A gate electrode of the second switch TFT ST2 is connected to the second gate lines 15B, a drain electrode of the second switch TFT ST2 is connected to the second node N2, and a source electrode of the second switch TFT ST2 is connected to the sensing voltage readout line 14B.

The data driving circuit 12 is connected to the pixel P through the data voltage supply line 14A and the sensing voltage readout line 14B. The sensing capacitor Cx for storing the source voltage of the second node N2 as the sensing voltage Vsen may be formed on the sensing voltage readout line 14B. The data driving circuit 12 includes a digital-to-analog converter (DAC), an analog-to-digital converter (ADC), an initialization switch SW1, and a sampling switch SW2.

In the sensing drive, the DAC may generate the sensing data voltage Vdata under the control of the timing controller 11 and may output the sensing data voltage Vdata to the data voltage supply line 14A. In the image display drive, the DAC may convert digital compensation data into the image display data voltage Vdata under the control of the timing controller 11 and may output the image display data voltage Vdata to the data voltage supply line 14A.

The initialization switch SW1 turns on a current flow between an input terminal of the initialization voltage Vpre and the sensing voltage readout line 14B in response to an initialization control signal SPRE (refer to FIGS. 7 and 8). In the sensing drive, the sampling switch SW2 turns on a current flow between the sensing voltage readout line 14B and the ADC in response to a sampling control signal SSAM (refer to FIG. 7), thereby supplying the source voltage of the driving TFT DT (as the sensing voltage), which is stored in the sensing capacitor Cx of the sensing voltage readout line 14B for a predetermined period of time, to the ADC. The ADC converts the analog sensing voltage stored in the sensing capacitor Cx into the digital value Vsen and supplies the digital sensing voltage Vsen to the timing controller 11. In the image display drive, the sampling switch SW2 continuously maintains the turn-off state in response to a sampling control signal SSAM (refer to FIG. 8).

An operation of the pixel P in the sensing drive is described below with reference to FIGS. 6 and 7.

The sensing drive through the fast mode sensing method according to the embodiment of the invention includes a programming period Tpg, a sensing and storing period Tsen, and a sampling period Tsam.

During the programming period Tpg, the gate-source voltage Vgs of the driving TFT DT is set so as to turn on the driving TFT DT. For this, the first and second sensing gate pulses SCAN and SEN and the initialization control signal SPRE are input at an on-level, and the sampling control signal SSAM is input at an off-level. Hence, the first switch TFT ST1 is turned on and supplies the sensing data voltage to the first node N1. Further, the initialization switch SW1 and the second switch TFT ST2 are turned on and supply the initialization voltage Vpre to the second node N2. In this instance, the sampling switch SW2 is turned off.

During the sensing and storing period Tsen, an increase in the source voltage of the driving TFT DT resulting from a current Ids flowing in the driving TFT DT is sensed and stored. During the sensing and storing period Tsen, the gate-source voltage Vgs of the driving TFT DT has to be held constant for the accurate sensing. For this, the first sensing gate pulse SCAN is input at the off-level, the second sensing gate pulse SEN is input at the on-level, and the initialization control signal SPRE and the sampling control signal SSAM are input at the off-level. During the sensing and storing period Tsen, a potential of the second node N2 increases due to the current Ids flowing in the driving TFT DT, and a charge voltage (i.e., a source voltage) of the second node N2 is stored in the sensing capacitor Cx via the second switch TFT ST2.

During the sampling period Tsam, the source voltage of the driving TFT DT, which is stored in the sensing capacitor Cx as the sensing voltage for a predetermined period of time, is supplied to the ADC. For this, the first sensing gate pulse SCAN is input at the off-level, the second sensing gate pulse SEN and the sampling control signal SSAM are input at the on-level, and the initialization control signal SPRE is input at the off-level.

In accordance with one embodiment of the invention, the sensing voltage may be obtained using only the fast mode sensing method and obtains a change amount of the mobility and a change amount of the threshold voltage in the driving TFT based on the sensing voltage. In one embodiment, the slow mode sensing method in the related art may not be used to obtain the change amount of the threshold voltage of the driving TFT. Because a sensing speed of the fast mode sensing method is several tens to several hundreds of times greater than a sensing speed of the slow mode sensing method using a source follower manner, time required in the sensing drive according to the embodiment of the invention is greatly reduced. Because the sensing drive according to the embodiment of the invention uses the fast mode sensing method, the sensing drive according to the embodiment of the invention may be performed in vertical blank periods VB belonging to an image display period X0 or a first non-display period X1 arranged prior to the image display period X0 as shown in FIG. 9. Because the embodiment of the invention obtains even the change amount of the threshold voltage of the driving TFT based on the sensing voltage obtained through the fast mode sensing method, the sensing drive does not need to be performed in a second non-display period X2 arranged after the image display period X0. In the embodiment disclosed herein, the vertical blank periods VB are defined as periods between adjacent image display frames DF. The first non-display period X1 may be defined as a period until several tens to several hundreds of frames passed from an application time point of a driving power enable signal PON. The second non-display period X2 may be defined as a period until several tens to several hundreds of frames passed from an application time point of a driving power disable signal POFF.

When a compensation value for compensating for the change amount of the mobility and the change amount of the threshold voltage in the driving TFT is determined through the sensing drive, the embodiment of the invention applies a compensation data voltage to the pixels P. The sensing drive is followed by the image display drive for displaying the image.

An operation of the pixel P in the image display drive is described below with reference to FIGS. 6 and 8.

As shown in FIG. 8, the image display drive according to the embodiment of the invention is dividedly performed in ①, ②, and ③ periods.

During the ① period, the initialization switch SW1 and the second switch TFT ST2 are turned on and reset the second node N2 to the initialization voltage Vpre.

During the ② period, the first switch TFT ST1 is turned on and supplies the compensation data voltage Vdata to the first node N1. In this instance, the second node N2 is held at the initialization voltage Vpre through the second switch TFT ST2. Thus, during the ② period, the gate-source voltage Vgs of the driving TFT DT is programmed to a desired level.

During the ③ period, the first and second switch TFTs ST1 and ST2 are turned off, and the driving TFT DT generates the driving current holed at a programmed level and applies the driving current holed to the OLED. The OLED emits light at brightness corresponding to the driving current holed and represents a grayscale.

Figure 10:
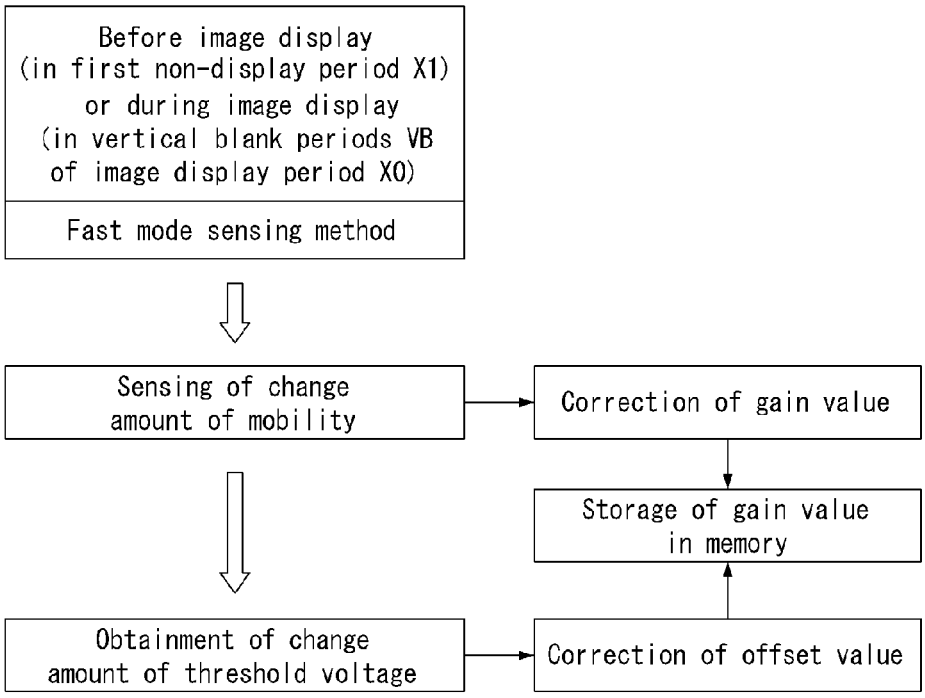
FIG. 10 illustrates a method for compensating for image quality of an organic light emitting display according to an exemplary embodiment of the invention.
Figure 11:
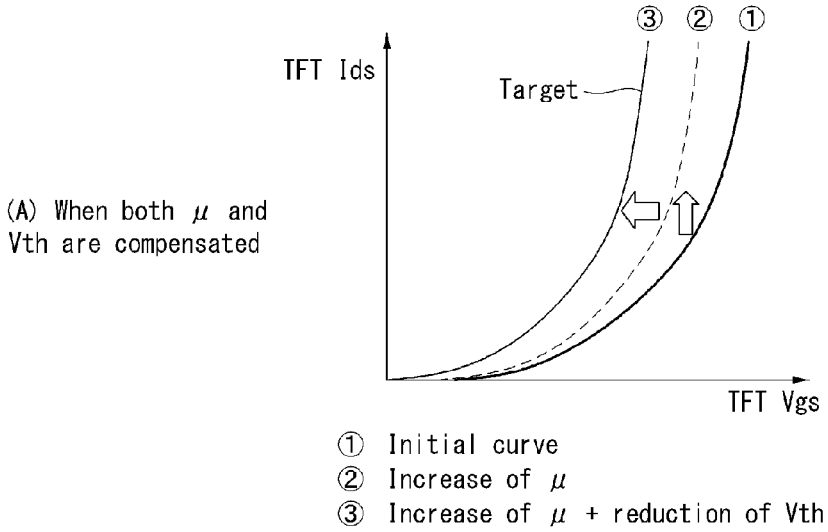
FIG. 11 shows a matching degree of a characteristic curve of a driving TFT when an embodiment of the invention is applied.
Figure 11:
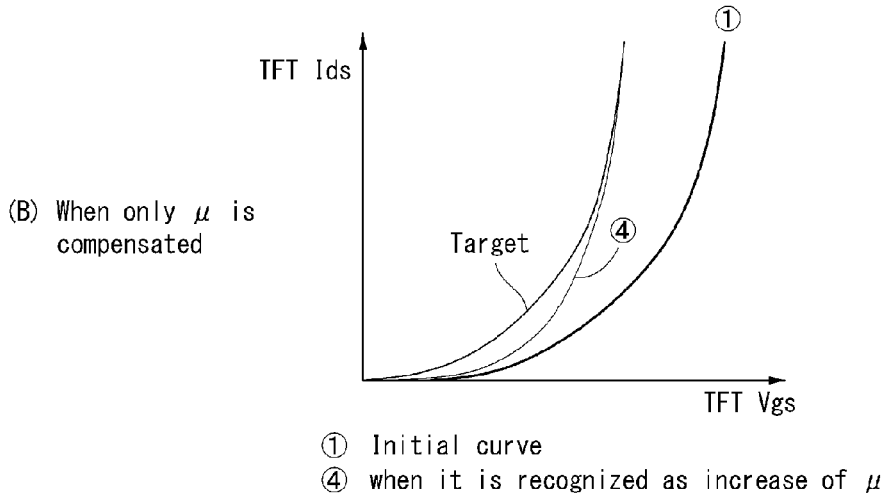

FIG. 10 illustrates a method for compensating for image quality of the organic light emitting display according to the embodiment of the invention. FIG. 11 shows a matching degree of a characteristic curve of the driving TFT when the embodiment of the invention is applied.

As shown in FIG. 10, as described above, the embodiment of the invention obtains the sensing voltage using the fast mode sensing method before the image display (in the first non-display period X1 of FIG. 9) or during the image display (in the vertical blank periods VB of the image display period X0 of FIG. 9) and senses a change amount of the mobility of the driving TFT based on the sensing voltage. The embodiment of the invention then obtains a change amount of the threshold voltage of the driving TFT depending on the change amount of the mobility. The embodiment of the invention may use a functional equation obtained when the change amount of the mobility is sensed, or may use a relationship between the change amount of the mobility and the change amount of the threshold voltage through a previously determined lookup table, so as to obtain the change amount of the threshold voltage. The change amount of the mobility is the basis of a correction and a calculation of a gain value, and the calculated gain value is stored in a memory. The change amount of the threshold voltage is the basis of a correction and a calculation of an offset value, and the calculated offset value is stored in the memory.

Because the embodiment of the invention may obtain the change amount of the threshold voltage using the fast mode sensing method capable of obtaining the change amount of the mobility, the logic size in the embodiment of the invention may be reduced. In the related art, an additional memory for storing an initial offset value and a separate offset value obtained in a drive-off process (in the second non-display period X2 of FIG. 9) was needed. However, because the embodiment of the invention may simultaneously perform the compensation of the mobility and the compensation of the threshold voltage through one process (in the first non-display period X1 and the vertical blank periods VB of the image display period X0 in FIG. 9), an additional memory is not necessary. The embodiment of the invention may continuously maintain an initial gain value in a first storage area of the memory or may update the initial gain value to a new value. Further, the embodiment of the invention may continuously maintain an initial offset value in a second storage area of the memory or may update the initial offset value to a new value.

Because the embodiment of the invention simultaneously performs the compensation of the mobility and the compensation of the threshold voltage through the one process, the embodiment of the invention may accurately compensate for a change characteristic of a real parameter of the TFT. Hence, the embodiment of the invention may maximize a compensation performance.

For example, it is assumed that an increase in the mobility μ and a reduction in the threshold voltage Vth are generated as a temperature rises. In this instance, as shown in (A) of FIG. 11, an initial characteristic curve ① of the TFT is changed to a final characteristic curve ③ of the TFT after passing through a middle characteristic curve ② of the TFT.

However, as shown in (B) of FIG. 11, when only the mobility μ is compensated by a drive of a long time as in the related art, the initial characteristic curve ① of the TFT is distorted to a final characteristic curve ④ of the TFT away from a target value. Such an error originates from the recognition, in which a current change was generated only by the change in the mobility μ without considering the change in the threshold voltage Vth. The compensation of the mobility μ is performed on the pixels of a relatively high gray level. Therefore, a compensation deviation increases at a middle gray level and a low gray level except the high gray level. On the other hand, because the embodiment of the invention performs both the compensation of the mobility μ and the compensation of the threshold voltage Vth through the one process, the result close to FIG. 11 may be obtained.

Figure 12:
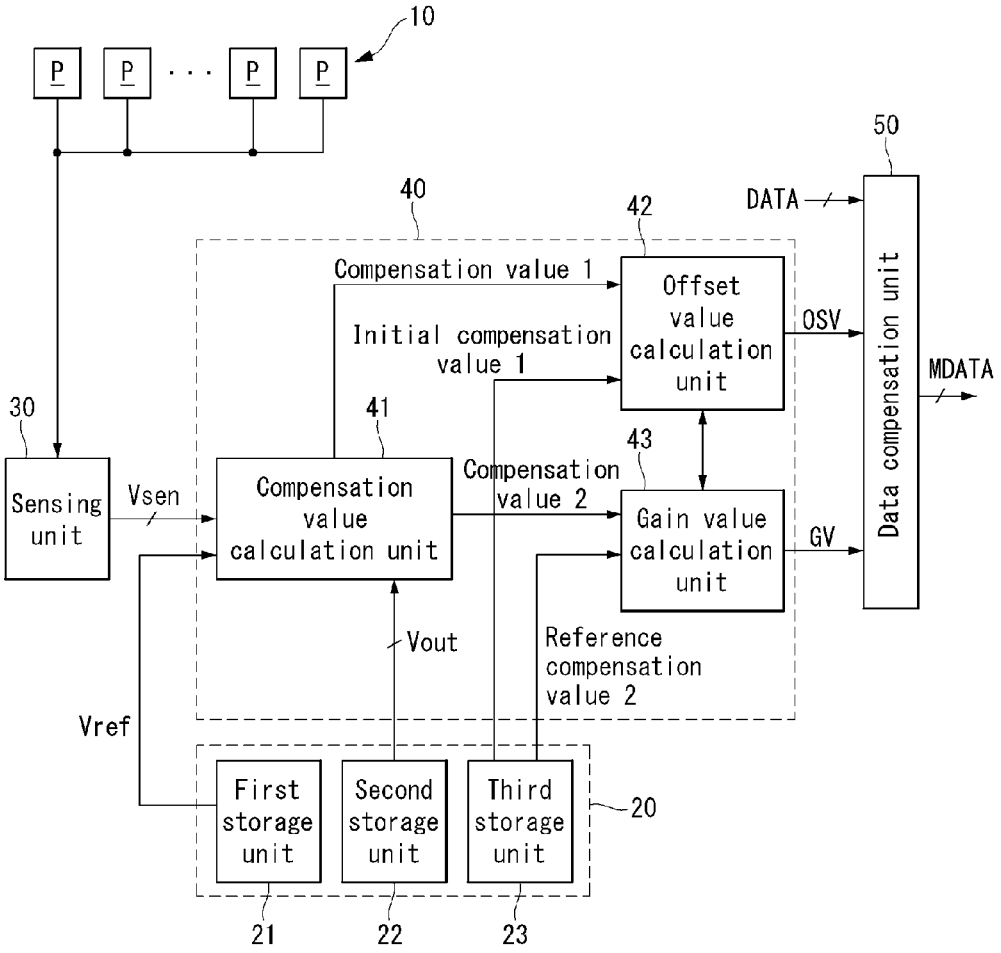
FIG. 12 shows an image quality compensation device of an organic light emitting display according to an exemplary embodiment of the invention.
Figure 13:
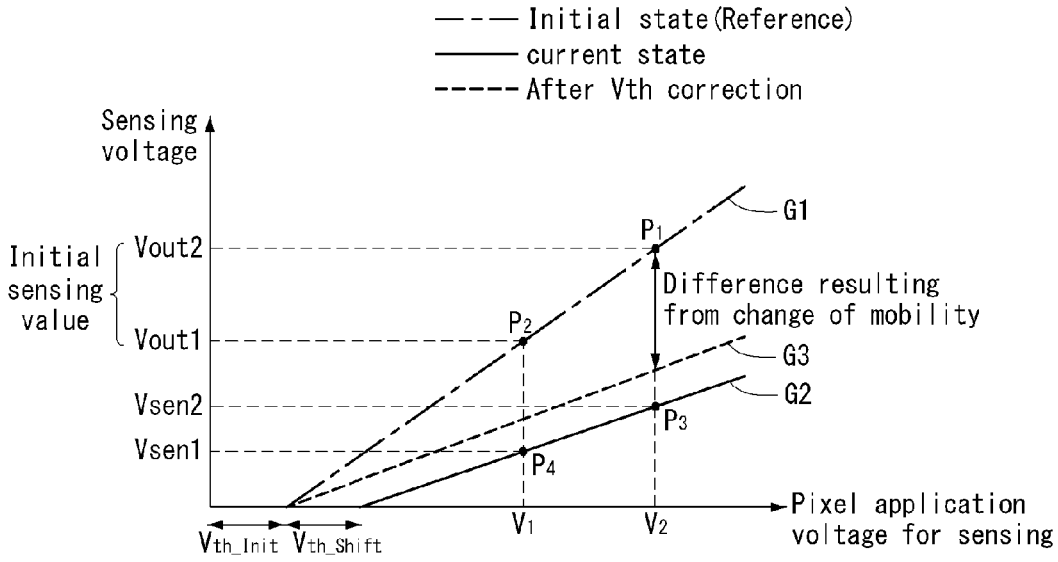
FIGS. 13 and 14 show an example of obtaining a change amount of a threshold voltage using an equation of Nth-order function obtained based on a sensing voltage.
Figure 14:
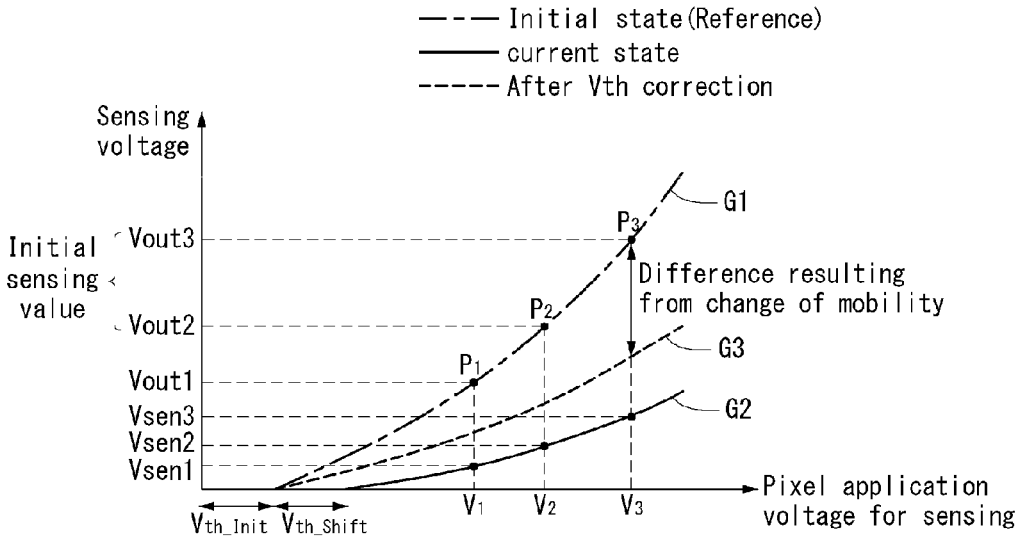
Figure 15:
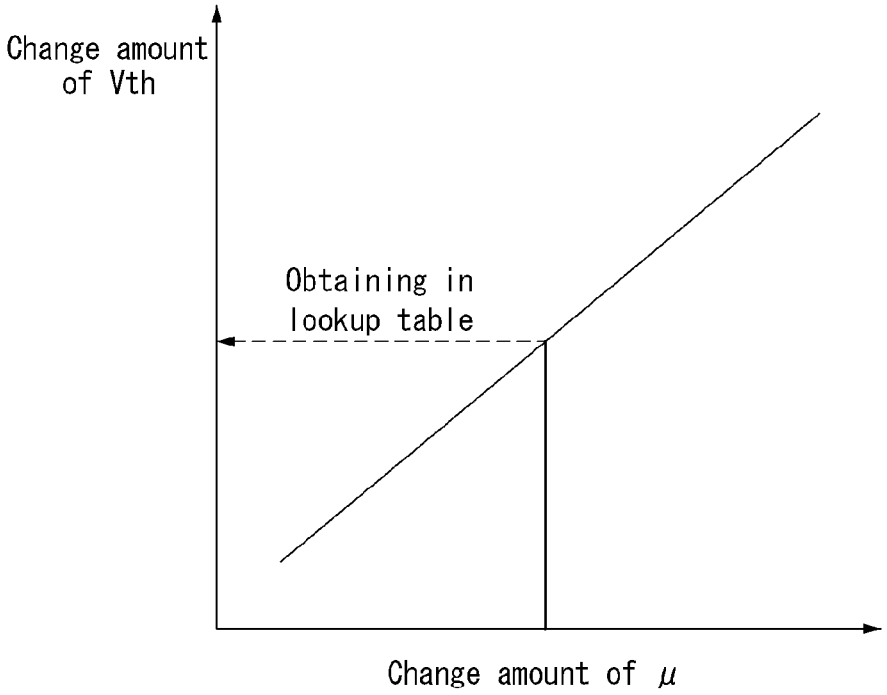
FIG. 15 shows an example of obtaining a change amount of a mobility based on a sensing voltage and obtaining a change amount of a threshold voltage using a relationship between the change amount of the mobility and the change amount of the threshold voltage in a previously determined lookup table.
Figure 16:
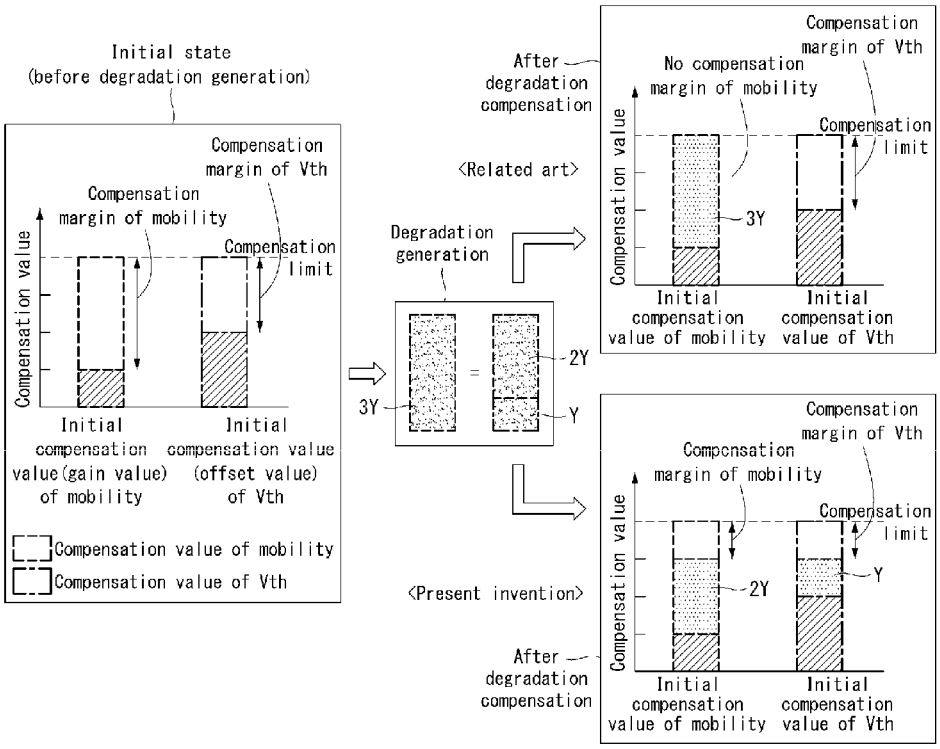
FIG. 16 illustrates a principle of an increase in a margin of a gain value for compensating for a change in a mobility as an effect of an embodiment of the invention.

FIG. 12 shows an image quality compensation device of the organic light emitting display according to the embodiment of the invention. FIGS. 13 and 14 show an example of obtaining the change amount of the threshold voltage using an equation of Nth-order function obtained based on the sensing voltage. FIG. 15 shows an example of obtaining the change amount of the mobility based on the sensing voltage and obtaining the change amount of the threshold voltage using a relationship between the change amount of the mobility and the change amount of the threshold voltage in a previously determined lookup table. FIG. 16 illustrates a principle of an increase in a margin of a gain value for compensating for the change in the mobility as an effect of the embodiment of the invention.

As shown in FIG. 12, the image quality compensation device of the organic light emitting display according to the embodiment of the invention includes a sensing unit 30, a compensation parameter determining unit 40, and a data compensation unit 50. The sensing unit 30 may be implemented as the data driving circuit 12, and the compensation parameter determining unit 40 and the data compensation unit 50 may be included in the timing controller 11.

The sensing unit 30 detects at least one sensing voltage Vsen from each pixel of the display panel through the fast mode sensing method.

The compensation parameter determining unit 40 obtains a change amount of the mobility of the driving TFT included in the pixel based on the sensing voltage Vsen and determines an offset value OSV for compensating for a change in the threshold voltage of the driving TFT and a gain value GV for compensating for a change in the mobility of the driving TFT based on the change amount of the mobility. For this, the compensation parameter determining unit 40 includes a compensation value calculation unit 41, an offset value calculation unit 42, and a gain value calculation unit 43.

The compensation value calculation unit 41 obtains the change amount of the mobility of the driving TFT based on the sensing voltage Vsen and obtains a change amount of the threshold voltage of the driving TFT based on the change amount of the mobility. The compensation value calculation unit 41 then obtains a compensation value 1 and a compensation value 2 depending on the change amount of the threshold voltage. The compensation value calculation unit 41 may use a functional equation as shown in FIGS. 13 and 14 or may use the lookup table as shown in FIG. 15, so as to obtain the compensation value 1 and the compensation value 2.

As shown in FIGS. 13 and 14, the compensation value calculation unit 41 obtains the equation of Nth-order function (where N is a positive integer equal to or greater than 2) for finding out the change amount of the mobility of the driving TFT based on the sensing voltage Vsen and may calculate the change amount of the threshold voltage using the equation of Nth-order function. To obtain the equation of Nth-order function, the compensation value calculation unit 41 applies the sensing data voltage of different levels to the same pixel N times to obtain the N sensing voltages Vsen. The compensation value calculation unit 41 may obtain coordinate points, at which the sensing data voltages and the sensing voltages correspond to each other.

For example, as shown in FIG. 13, the compensation value calculation unit 41 calculates an equation 1 of a linear function corresponding to a graph 1(G1) having coordinate points P1 and P2 through initial sensing values Vout1 and Vout2 corresponding to first and second sensing data voltages V1 and V2. In the embodiment disclosed herein, the initial sensing values Vout1 and Vout2 are sensed in a product shipping step and are previously stored in the memory. In the sensing drive, the compensation value calculation unit 41 again applies the first and second sensing data voltages V1 and V2 to the pixel and obtains first and second sensing voltages Vsen1 and Vsen2 corresponding to the first and second sensing data voltages V1 and V2, thereby calculating an equation 2 of a linear function corresponding to a graph 2(G2) having coordinate points P3 and P4 through them. The compensation value calculation unit 41 obtains a difference between a slope of the functional equation 1 and a slope of the functional equation 2 and calculates the result of the difference as the change amount of the mobility of the driving TFT. The compensation value calculation unit 41 then calculates the change amount of the threshold voltage of the driving TFT based on the calculated change amount of the mobility. Namely, the compensation value calculation unit 41 moves the graph 2(G2) toward the graph 1(G1) to obtain a graph 3(G3), which shares x-intercept with the graph 1(G1). Further, the compensation value calculation unit 41 calculates a difference between slopes of the graphs 1(G1) and 3(G3) as the change amount of the mobility of the driving TFT and calculates a difference between x-intercepts of the graphs 2(G2) and 3(G3) as a change amount Vth_Shift of the threshold voltage of the driving TFT. In FIG. 13, 'Vth_Init' denotes an initial threshold voltage of the driving TFT. As shown in FIG. 14, the compensation value calculation unit 41 may calculate the change amount of the mobility of the driving TFT and the change amount of the threshold voltage of the driving TFT through an equation of a quadratic function obtained through three sensing operations.

Next, as shown in FIG. 15, the compensation value calculation unit 41 previously stores a relationship between the change amount of the mobility and the change amount of the threshold voltage in the driving TFT depending on changes in a temperature using a lookup table. When the change amount of the mobility of the driving TFT is obtained depending on a deviation between a reference voltage Vref and the sensing voltage Vsen, which are read from the memory 20, the compensation value calculation unit 41 may derive the change amount of the threshold voltage of the driving TFT from the change amount of the mobility of the driving TFT using the relationship stored in the lookup table.

As described above, when the compensation value 1 and the compensation value 2 are calculated, the offset value calculation unit 42 compares a reference compensation value 1 read from the memory 20 with the compensation value 1 to calculate an offset value. The gain value calculation unit 43 compares a reference compensation value 2 read from the memory 20 with the compensation value 2 to calculate a gain value.

In the embodiment disclosed herein, the reference compensation value 1 is fixed to an initial compensation value, which is previously determined, or is updated to the compensation value 1 every predetermined sensing period. In this instance, the compensation value 1 calculated in an (N−1)th period may be selected as the reference compensation value 1 in an Nth period. In the same manner as the reference compensation value 1, the reference compensation value 2 is fixed to an initial compensation value, which is previously determined, or is updated to the compensation value 2 every predetermined sensing period. In this instance, the compensation value 2 calculated in the (N−1)th period may be selected as the reference compensation value 2 in the Nth period.

The data compensation unit 50 applies the gain value and the offset value to the input digital video data DATA and generates the digital compensation data MDATA to be applied to the pixel. More specifically, the data compensation unit 50 multiplies the gain value by a gray level of the input digital video data DATA and adds the offset value to the result of multiplication, thereby generating the digital compensation data MDATA.

An operation effect of the embodiment of the invention is summarized as follows.

First, because the embodiment of the invention may find out the change amount of the threshold voltage of the driving TFT using the mobility sensing method having the fast sensing speed, an amount of memory used, the logic size, and time required in the sensing drive may be greatly reduced.

Second, the embodiment of the invention may perform the compensation of the mobility and the compensation of the threshold voltage through one process, and thus may accurately compensate for the change characteristic of the real parameter of the TFT. Hence, the embodiment of the invention may maximize the compensation performance.

Thirdly, because the embodiment of the invention performs the compensation of the mobility and the compensation of the threshold voltage through the one process, a compensation process may be simplified. Further, the simple compensation process increases the user convenience.

Fourthly, because the embodiment of the invention performs the compensation of the mobility and the compensation of the threshold voltage through the one process, a margin of the compensation value for compensating for the change amount of the mobility may be sufficiently secured as compared with the related art. As shown in FIG. 16, it is assumed that a degradation of 3Y is generated due to the continuous image display drive, and thus the mobility and the threshold voltage of the driving TFT have to be additionally compensated by 2Y and Y from an initial state, respectively. The effect of the embodiment of the invention is additionally described below as compared with the related art.

In the related art image quality compensation technology, because the compensation of the change amount of the threshold voltage of the driving TFT can be performed only in the second non-display period X2 of FIG. 9, only the mobility has to be additionally compensated by 3Y from the initial state, so as to compensate for the degradation of 3Y generated in the image display period X0. In the related art, it is difficult to secure the margin of the compensation value for compensating for the mobility.

On the other hand, the embodiment of the invention can perform the compensation of the threshold voltage of the driving TFT along with the compensation of the mobility of the driving TFT in the first non-display period X1 or the image display period X0 shown in FIG. 9. Therefore, the mobility and the threshold voltage of the driving TFT can be additionally compensated by 2Y and Y from the initial state, respectively. Hence, in the embodiment of the invention, it is easy to secure the margin of the compensation value for compensating for the mobility.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode (OLED) display device including a plurality of pixels to display images, each of the pixels including an OLED, a driving transistor connected to the OLED, and a switching transistor configured to supply data signals to the OLED, the device comprising:

a sensor configured to sense at least one voltage associated with a change amount of a mobility of the driving transistor, wherein the at least one voltage includes first and second output voltages sensed from the driving transistor in response to applying first and second data voltages to the driving transistor;

a compensation value calculator configured to obtain a change amount of a threshold voltage of the driving transistor based on a sensed change amount of the mobility, wherein the compensation value calculator is further configured to:

obtain a functional relationship between the first and second output voltages and the first and second data voltages;

obtain a slope of a graph representing the functional relationship with respect to data voltages;

obtain a reference slope of a reference graph representing reference output voltages with respect to reference data voltages on the driving transistor; and obtain the sensed change amount of the mobility of the driving transistor based on the slope and the reference slope; and a data compensator configured to adjust the data signals based on the sensed change amount of mobility and the obtained change amount of the threshold voltage.

2. The OLED display device of claim 1, wherein the sensor is further configured to detect a sensing voltage at a source of the driving transistor in response to the driving transistor being turned on by a voltage greater than the threshold voltage of the driving transistor.

3. The OLED display device of claim 1, wherein the sensed change amount of the mobility is obtained during a non-display period before an image display begins or during a vertical blank period of an image display period.

4. The OLED display device of claim 1, wherein the compensation value calculator is further configured to obtain the change amount of the threshold voltage without operating the driving transistor in a saturation state where a current between a source and a drain of the driving transistor becomes zero to detect a source voltage of the driving transistor.

5. The OLED display device of claim 1, wherein the compensation value calculator is further configured to obtain the change amount of the threshold voltage based on the sensed change amount of the mobility and a function or a database relating to a correlation between the sensed change amount of the mobility and the change amount of the threshold voltage.

6. The OLED display device of claim 1, further comprising:

a gain value calculator configured to obtain a gain value for data compensation based on the sensed change amount of the mobility; and an offset value calculator configured to obtain an offset value for data compensation based on the obtained change amount of the threshold voltage, wherein the data compensator is further configured to adjust the data signals based on the gain value and the offset value.

7. The OLED display device of claim 1, wherein the compensation value calculator is further configured to:

obtain an intercept of the graph on an axis with respect to the data voltages;

obtain a reference intercept of the reference graph on the axis; and obtain the change amount of the threshold voltage of the driving transistor based a difference between the intercept and the reference intercept.

8. A method for compensating for variations of an organic light emitting diode (OLED) display device, the OLED display device including a plurality of pixels to display images, and each of the pixels including an OLED, a driving transistor connected to the OLED, and a switching transistor configured to supply data signals to the OLED, the method comprising:

sensing a change amount of a mobility of the driving transistor;

obtaining a change amount of a threshold voltage of the driving transistor based on the sensed change amount of the mobility; and adjusting the data signals based on the sensed change amount of the mobility and the obtained change amount of the threshold voltage, wherein the step of sensing the change amount of the mobility comprises:

applying first and second data voltages to the driving transistor;

sensing first and second output voltages from the driving transistor;

obtaining a functional relationship between the first and second output voltages and the first and second data voltages;

obtaining a slope of a graph representing the functional relationship with respect to data voltages;

obtaining a reference slope of a reference graph representing reference output voltages with respect to reference data voltages on the driving transistor; and obtaining the sensed change amount of the mobility of the driving transistor based on the slope and the reference slope.

9. The method of claim 8, wherein the step of sensing the change amount of the mobility comprises detecting a sensing voltage at a source of the driving transistor in response to the driving transistor being turned on by a voltage greater than the threshold voltage of the driving transistor.

10. The method of claim 8, wherein the step of sensing the change amount of the mobility is performed during a non-display period before an image display begins or during a vertical blank period of an image display period.

11. The method of claim 8, wherein the change amount of the threshold voltage is obtained without operating the driving transistor in a saturation state where a current between a source and a drain of the driving transistor becomes zero to detect a source voltage of the driving transistor.

12. The method of claim 8, wherein the change amount of the threshold voltage is obtained, based on the sensed change amount of the mobility, by using a function or a database relating to a correlation between the sensed change amount of the mobility and the change amount of the threshold voltage.

13. The method of claim 8, further comprising:

obtaining a gain value for data compensation based on the sensed change amount of the mobility; and obtaining an offset value for data compensation based on the obtained change amount of the threshold voltage, wherein the data signals are adjusted based on the gain value and the offset value.

14. The method of claim 8, wherein the step of obtaining the change amount of threshold voltage comprises:

obtaining an intercept of the graph on an axis with respect to the data voltages;

obtaining a reference intercept of the reference graph on the axis; and obtaining the change amount of the threshold voltage of the driving transistor based a difference between the intercept and the reference intercept.

15. A method for compensating for variations of an organic light emitting diode (OLED) display device, the OLED display device including a plurality of pixels to display images, and each of the pixels including an OLED, a driving transistor connected to the OLED, and a switching transistor configured to supply data signals to the OLED, the method comprising:

applying first and second data voltages to the driving transistor;

sensing first and second output voltages from the driving transistor;

obtaining a functional relationship between the first and second output voltages and the first and second data voltages;

obtaining a slope of a graph representing the functional relationship with respect to data voltages;

obtaining a reference slope of a reference graph representing reference output voltages with respect to reference data voltages on the driving transistor;

obtaining a sensed change amount of a mobility of the driving transistor based on the slope and the reference slope;

obtaining a change amount of a threshold voltage based on the sensed change amount of the mobility; and adjusting the data signals based on the sensed change amount of the mobility and the obtained change amount of the threshold voltage.

16. The method of claim 15, wherein the obtaining the change amount of the threshold voltage comprises:

obtaining an intercept of the graph on an axis with respect to the data voltages;

obtaining a reference intercept of the reference graph on the axis; and obtaining the change amount of a threshold voltage of the driving transistor based on a difference between the intercept and the reference intercept.

* * * * *